US005535470A

United States Patent [19]

Baranowski

[11] Patent Number: 5,535,470

[45] Date of Patent: Jul. 16, 1996

[54] SIDEWAYS SLIDABLY MOUNTED WHEELCHAIR ACCESS PATHWAYS

[76] Inventor: Edwin M. Baranowski, 75 Marrus Dr., Grahanna, Ohio 43230

[21] Appl. No.: 320,003

[22] Filed: Oct. 7, 1994

Related U.S. Application Data

[63] Continuation-in-part of Ser. No. 86,252, Jul. 1, 1993, and a continuation-in-part of Ser. No. 243,565, May 16, 1994, which is a continuation-in-part of Ser. No. 826,838, Jan. 27, 1992, Pat. No. 5,319,818, said Ser. No. 86,252, Jul. 1, 1993, and a continuation of Ser. No. 826,838, Jan. 27, 1992, Pat. No. 5,319,818.

[51] Int. Cl.[6] ..... E01D 1/00

[52] U.S. Cl. ..... 14/69.5; 14/71.1; 49/158; 49/176; 414/537; 414/921

[58] Field of Search ..... 14/69.5, 71.1; 414/522, 537, 538, 539, 540, 921; 296/61

[56] References Cited

U.S. PATENT DOCUMENTS 4,879,843 11/1989 Hamamoto et al. ..... 49/158
4,966,516 10/1990 Vartanian ..... 414/537
5,096,362 3/1992 Best ..... 414/537
5,380,145 1/1995 Czaplewski ..... 414/537

*Primary Examiner*—William P. Neuder
*Assistant Examiner*—Pamela A. O'Connor

[57] ABSTRACT

A sideways slidable pathway system for wheelchair users that permits the temporary deployment of pathways to allow the transit of a wheelchair with a person therein over a stair or stairway barrier, in which the pathway, which itself may comprise one or more separate pathways, are permanently secured to an anchor adjacent an access opening and are rotationally disposable and slidable with respect to a track from a position in which the pathway is stowed away and not in use to a position in which the pathway is disposed over the stair barrier so that transit can be accomplished.

13 Claims, 3 Drawing Sheets

SIDEWAYS SLIDABLY MOUNTED WHEELCHAIR ACCESS PATHWAYS

This is a continuation-in-part of my prior applications, Ser. No. 08/243,565, filed May 16, 1994 and Ser. No. 08/086,252, filed Jul. 1, 1993, both of which were continuations-in-part of, and incorporating by reference, my application, Ser. No. 07/826,838, filed Jan. 27, 1992, now U.S. Pat. No. 5,319,818, and all of which in their entireties are incorporated by reference herein.

FIELD OF THE INVENTION

This invention relates to stairway accessibility means for wheelchair challenged persons. In particular, the invention provides temporary access for wheelchair users over a limited stairway barrier and is preferably used with an assistant who guides the wheelchair. The device is permanently installable adjacent a stairway, does not encumber or obstruct the stairway when not in use, is easily deployed and achieves wheelchair access over limited stairway barriers in many circumstances.

BACKGROUND OF THE INVENTION

My referenced U.S. Patent describes problems of accessibility encountered by wheelchair users and relates to the use of access pathways extending over a barrier, such as a stairway, paired such that each pathway is capable of receiving thereon the side wheels of each side of the wheelchair. There is a space between the pathways that allows footed access to the stairway by an assistant. In this manner, the pathways provide the mechanical advantage of an inclined plane for the passage of the wheelchair up or down the stairway, while the assistant, who guides the wheelchair, remains comfortable and secure using the stairway as it is intended to be used as a footpath.

OBJECTS OF THE INVENTION

It is an object of the invention to provide a temporarily deployable wheelchair access means that is slideably retractable with respect to a stair barrier, yet is permanently attached adjacent thereto for ready deployment when needed. As a result, space savings are achieved when compared to a conventional 1:12 to 1:20 ramp with respect to the same stairway barrier. This is an important feature in space intensive locations, such as split level homes and other facilities where room space may be at a premium, or in restaurants having a stair or stairs between different levels. The use of square footage is an actual cost in most instances. For example, a one meter (or 36 inch) wide ramp having a 1:15 grade extending over a stair having a 20 centimeter (approximately 8 inches) riser would occupy about 3 square meters (or about 3.33 square yards). In a restaurant, this space is about equivalent to that used for a table, or tables, for four or more guests, an important factor in guest comfort as well as financial return expected from space utilization.

SUMMARY OF THE INVENTION

Fulfilling these objects, the invention provides a permanent access appliance that is space conserving and can be deployed when needed, but retracted out of the way when not in use, and which provides advantages over conventional ramp systems for the usually assisted transit of a person in a wheelchair. A sideways slidable system for wheelchair access is provided for use in locations, such as at doorways or an extended width stair or stairway that does not have a wall or handrail to which a pathway system may be readily attached.

These and other objects of the invention will be more readily understood when the specification is considered in conjunction with the accompanying drawings:

DESCRIPTION OF THE PREFERRED EMBODIMENT

The invention provides a temporary pathway over the transit of a wheelchair over a stair barrier. The pathway is readily installed and easily deployed.

Figure 1:
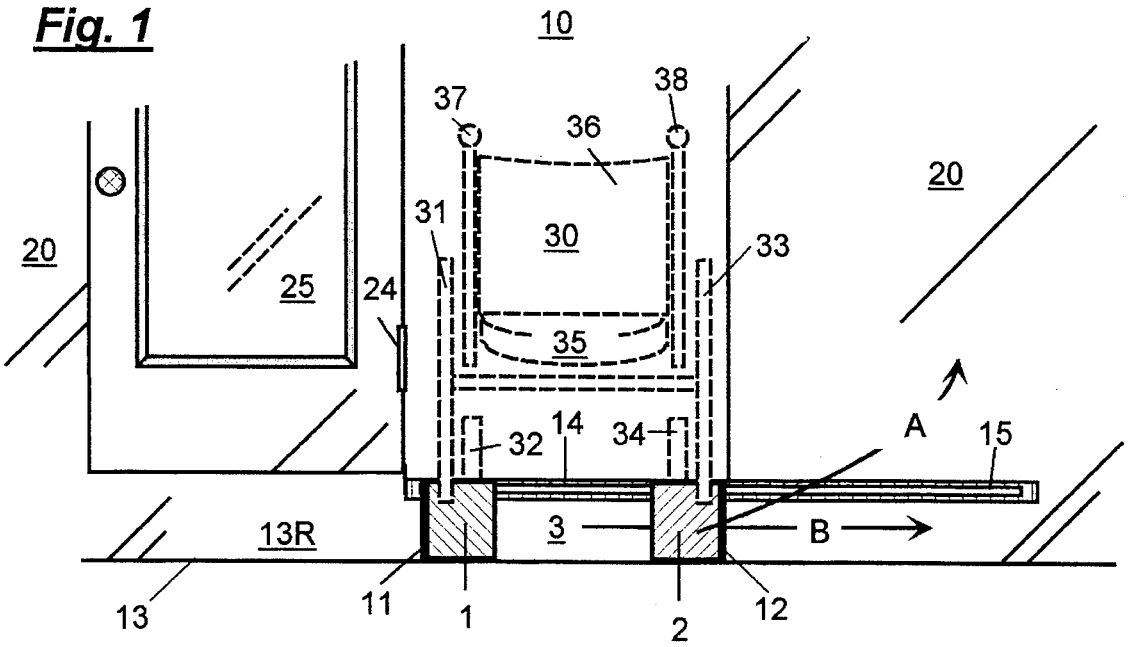
FIG. 1 shows a front view of the system installed at a stair in front of a doorway or other access opening.
Figure 1A:
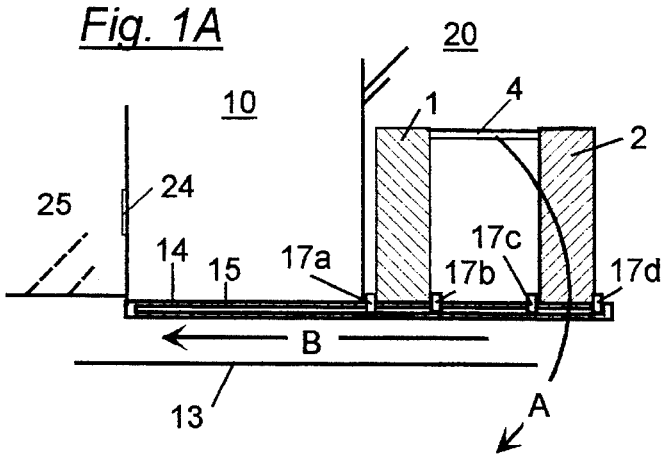
FIG. 1A shows a front view of the system of FIG. 1 retracted against a wall adjacent the doorway in a "not in use" mode.

As illustrated in FIG. 1, the device includes parallel extended pathways 1 and 2 which are sufficiently wide so as to be capable of receiving thereon the wheels of a wheelchair. (Either a four wheel or a three wheel "tripod" type chair may be accommodated. (See FIG. 1B.)) The upper surface of the pathways should be slip-resistant, or include thereon, or be formed from, a traction enhancing material. The pathways, when used with a four wheel chair, are separated such that a step through path 3 is allowed for an assistant when the pathways are placed across a stair or stairway. The pathways may be maintained in a spaced apart and parallel relationship by a lateral spacer and connector member, such as 4 shown in FIG. 1A at an end of the pathways. Optional side curbs on the pathways shown at 11 and 12 prevent the wheelchair from deviating from the pathway during its transit thereover.

In FIG. 1, the device is installed at a stair or stairway barrier leading up or down, from or to, lower level 13 and upper level 14 leading through riser 13R to an access opening 10, illustrated in FIG. 1 as a doorway in wall 20. As shown, the doorway includes door 25, attached, inter alia, by hinge 24. A conventional wheelchair is shown in phantom view in FIG. 1 at 30 having rear 31 and front 32 wheels on one side paired with rear 33 and front 34 wheels on the other side. The wheelchair includes seat 35, back 36, and pushing or guiding handles for an assistant at 37 and 38.

The pathways preserve the mechanical advantage of an inclined plane for the wheelchair, and allow stair access for the assistant who guides the wheelchair up or down the pathway. Because the pathways are generally deployed only when needed, the stair or stairway is not permanently changed, and a ramp does not otherwise interfere with conventional access, a consideration expressed by persons using canes or walkers or the visually challenged. In addition, the pathways promote visual alignment of the wheelchair wheels on the pathways. By sight and footing, the comfort level created in the wheelchair user and an assistant in using the device is improved over that of a ramp when used at stair inclines.

Figure 1B:
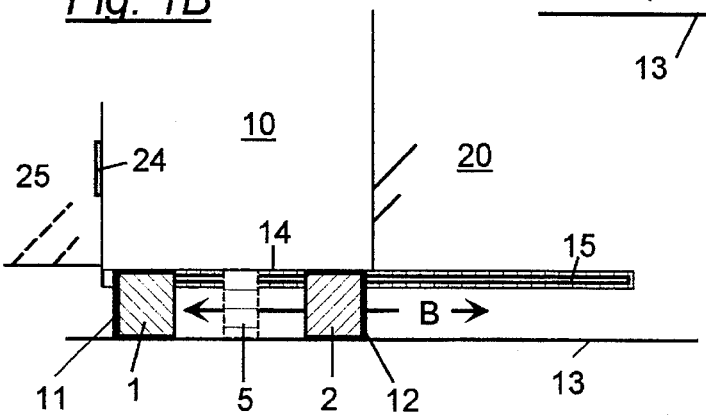
FIG. 1B shows a front view of the system of FIG. 1 adapted to a tripod wheelchair.
Figure 1C:
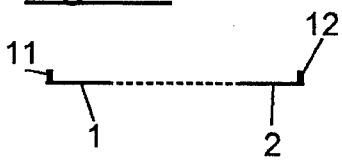
FIG. 1C shows a cross-section of the pathways taken perpendicularly across the lengthwise axis thereof.

The pathway formed from wheel pathways 1 and 2 is secured to a horizontally sliding support mechanism adjacent the stair or stairway. With reference to FIG. 1, a sliding track 15 is installed at upper level 14, essentially parallel to and having an upper section in alignment with the upper level 14. (Stairway level differences are essentially parallel and horizontal.) The pathways 1 and 2 are connectable to the track, for example, by means shown in FIG. 2. In FIG. 1B, a third separate pathway 5 is included between two side pathways to accommodate a three wheel, or a tripod, scooter type of wheelchair. Pathway 5 may be a third or middle pathway element in a sliding track system, or may otherwise be provided as separate add on or plug in element adapted to be used with a two pathway system, but nevertheless maintained as a option or accessory therefor. The middle pathway 5 need not be part of the slide system, but can be affixed with a pin, connector, plug, snap, an anchoring device, or other like fastener to traverse the upper and lower levels parallel to the side pathways. Depending on the anticipated need for a three pathway system, the center pathway can be permanently included in the slide mechanism, or provided as an add on.

Figure 2:
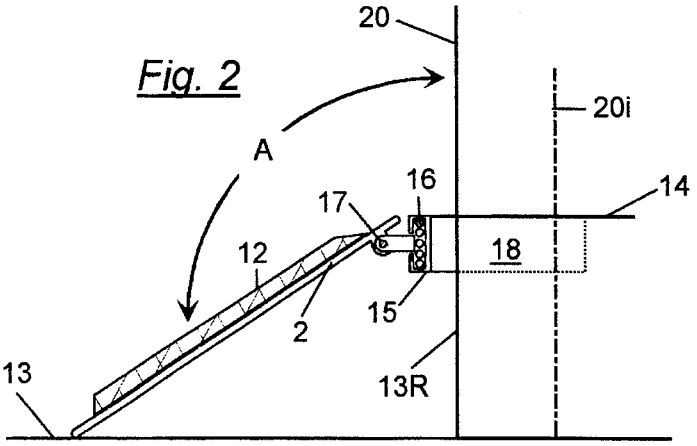
FIG. 2 depicts a cross-sectional side view of the system deployed, showing an example of a sliding track.
Figure 2A:
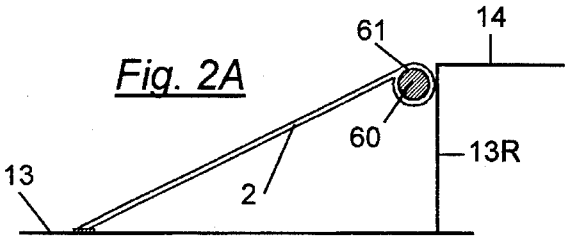
FIG. 2A depicts a cross-sectional side view of an alternative circular rod/ring system.

FIG. 2 shows a side cross-section of the track mechanism in which the pathways slide horizontally with respect to the levels from locations within the access opening (when the pathways are downwardly deployed) to locations adjacent a side of the access opening (when the pathways are not in use and are retracted up against the wall. ) Wall 20 is shown having interior side 20*i*. The direction(s) of the sideways sliding movement of the pathway is shown in the, figures by arrow B. In FIG. 2, the pathway 2, as viewed from the fight side of FIG. 1, includes edge curb 12 and extends along the incline from lower level 13 to upper level 14. Sliding track 15 is secured to the upper front edge of the tread 18 extending from the upper surface of the upper level 14. The track substitutes for, is added to, or is included within the molding or nose extension conventional to a tread or treads of a stair or stairway, and in this manner may be designed with a shape, texture and/or coloration as to be essentially transparent to an ambient decorating scheme. The slide system may be concealed when not in use in the manner of a pocket door that slides within a wall. In the track illustrated in FIG. 2, the sliding mechanism 16 is shown as including a roller bearing assembly within track 15 that is depicted as a "C-channel", however, many of a multitude of known slides or sliding track mechanisms, with and without bearings, may be adapted for use with the invention. A hinge 17 or other means allowing rotational movement of the pathway connects the pathway to the sliding track and allows upward and downward movement of the pathway with respect to the wall 20 and lower level 13 about the hinge axis as shown in the figures by arrow A. In FIG. 2A, a circular cross-sectioned rod 60 is shown as a track, cooperating slidingly with ring 61 to which the pathway is secured. As shown, the pathway may be integrally formed with the slide that cooperates with the track.

Figure 3:
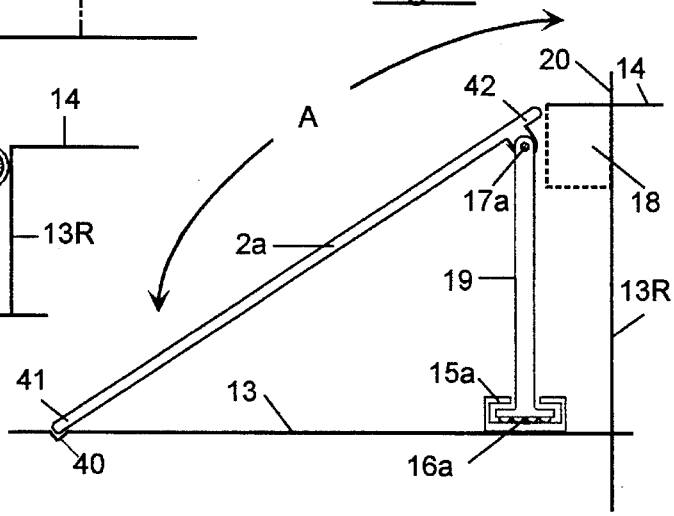
FIG. 3 is a cross-sectional side view showing an alternative sliding track location.

In the alternative of FIG. 3, the track or slide 15*a* is affixed to the lower level 13 and the cooperative slide mechanism therein 16*a* includes a vertical extension 19 that connects to pathway 2*a* by the rotation allowing means 17*a*. The vertical extension is sized such that the upper end 42 of the pathway is in essentially horizontal alignment with the upper surface of the upper level 14.

FIG. 3 additionally shows a groove, inset or other receptacle 40 for receiving the lower end 41 of the pathway 2*a* to additionally secure the pathway in a firm position with respect to lower level 13 when the pathway is deployed.

Figure 4:
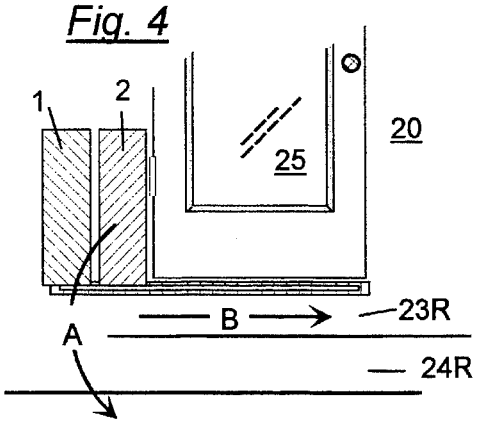
FIG. 4 depicts an alternative embodiment achieving savings in wall space.

FIG. 4 shows two pathways in a shorter track, in which the pathways are independently moveable. This arrangement conserves wall space. FIG. 4 additionally shows a "toggle" arrangement when the pathways are stowed on the hinge side of a door and the door opens outward toward that side. It is evident in this arrangement that the pathways should be deployed downward and moved sideways in from of the door before the door is opened. When wheelchair access is made to the upper level, the door may be closed and the pathways will remain deployed (for example, overnight). On exit, the door opens and the pathways are deployed. After exiting, the door may be closed and the pathways can then be retracted against the wall. FIG. 4 also shows the system used at multiple stairs, separated by risers 23R and 24R.

Figure 4A:
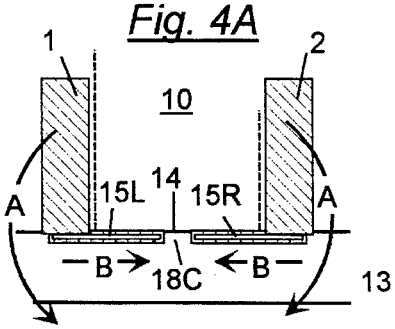
FIG. 4A depicts an embodiment in which tracks and pathways are installed at each side of an access opening.

In FIG. 4A the separate pathways 1 and 2 are each provided at an opposite side of an access opening 10. Each respectively includes its own slide or track, as indicated at 15L and 15R. The tracks on each side may be joined at the center 18C, or a gap thereat may be filled.

Figure 5:
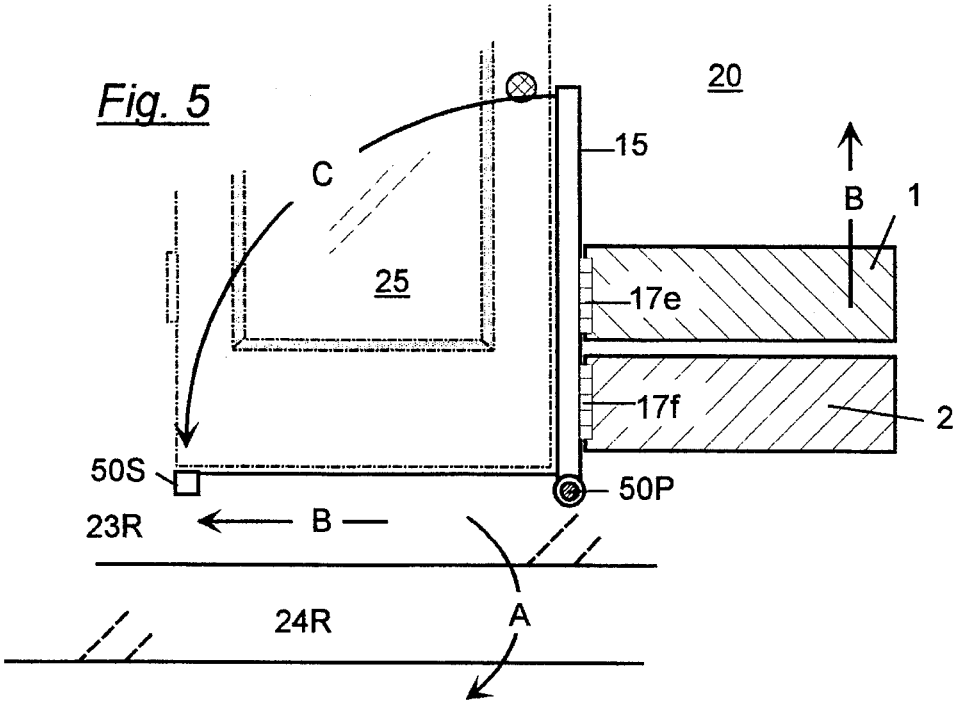
FIG. 5 and FIG. 5A depict vertically oriented systems.

FIG. 5 shows an embodiment that is yet even more conserving of wall space that may be useful for one or two stairs. In FIG. 5 the end of the track is allowed to pivot at the lower corner of the access opening, at pivot point 50P. This allows the track to rotate from an essentially vertical (not in use) position to a horizontal (in use) position in alignment with the levels of the stairs, where the track is then held in a fixed position by a cooperative securing device 50S, such as a receiving channel, a clip, pin, screw, snap, or the like. After this 90 degree pivot is made, shown by arrow C, the pathways can be slideably deployed sideways along the track, shown by arrow B, and rotated downwardly, as shown by arrow A, to provide the pathway traversing the stairs from the upper level to the lower level, as discussed above.

The pathways may be fixed in their separation (See FIG. 1A.), or one pathway may be moveable with respect to the other along the track, or both pathways may be moveable.

Figure 5A:
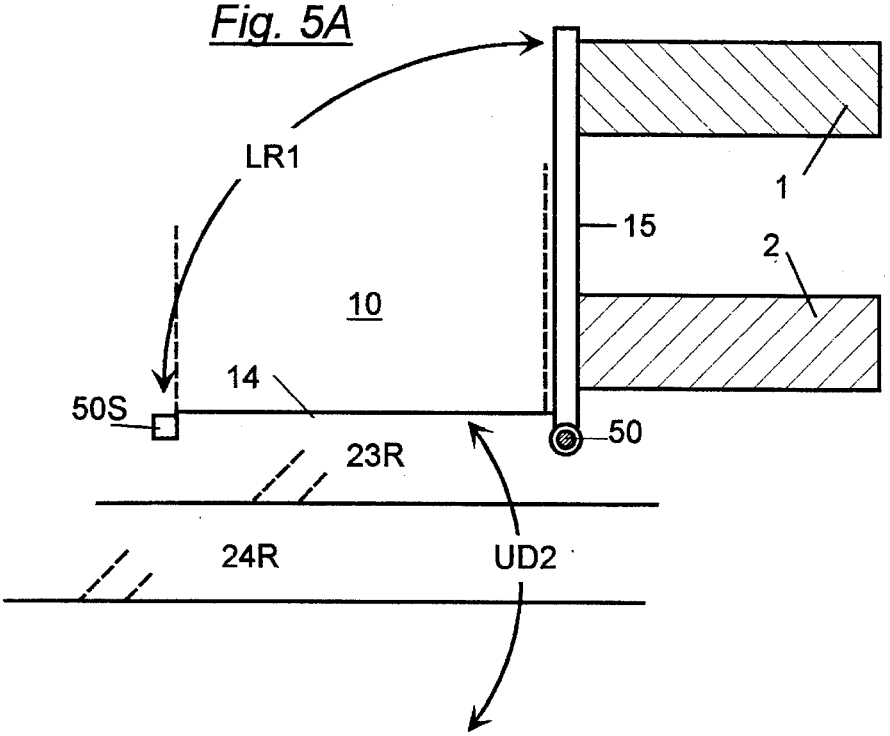

In the embodiment of FIG. 5A, a bi-axial rotator is affixed to the pivot point 50 and connects the pathways 1 and 2 secured in an assembly to track 15. When a bi-axial rotator is used, the pathways need not be hinged to the track, as the track will also rotate from the horizontal axis of the rotator 50. Alternatively, a single axis pivot can be provided and the pathway may be rotatable in the track by a ring/rod arrangement such as shown in FIG. 2*a*. Vertical rotation is allowed from the side of the opening to level 14, and back, as shown by arrow LR1, and the downward/upward deployment of the pathways across the stairway occurs, as shown by arrow UD2.

In most instances, because the slope of the pathways will likely correspond to the from edge of the stair treads to be traversed, an assistant to guide and push or restrain the wheelchair will be necessary. Subject to environment circumstances, there is no limit to the length of the pathways that may be used, and the system may be optionally adapted to provide a conventional 1:12 to 1:20 slope with respect to a stairway traversed to allow independent access to a wheelchair user.

The dimensions and proportions and the materials of fabrication depend on design considerations of durability, weight, public or institutional use, or other considerations, provided however, that good design criteria for the wheelchair application, given the foregoing disclosure, are satisfied. Similarly, the operations of the system are adaptable to being mechanized for automatic operation in accordance with a command signal, if desired.

What is claimed is:

1. A temporarily deployable path for providing the assisted transit of a wheelchair having a pair of side wheels with a person therein over a stair or stairway barrier connecting a lower level and an upper level with respect to an access opening between the levels, the path comprising:

a pair of longitudinally extended pathways, each having a sufficient width for receiving thereon the side wheels on one side of the wheelchair, the pathways being extensible over the stair or stairway barrier, and extending from and to the lower and upper levels;

a slide secured to an anchor adjacent the access opening, the slide being sufficient in length to extend laterally from a location within said opening to a location beside said opening, the slide being deployable substantially parallel to at least one of the levels;

the pathways being securable to the slide and being moveable therein in lateral positions extending from within the access opening to an outer side thereof such that when the pathways are disposed within the access opening, the pathways are spaced apart from each other and each receives thereon the wheels on one side of the wheelchair and the space between the pathways allows footed access to the stair or stairway by an assistant and when the pathways are disposed beside the access opening the pathways do not obstruct the stair or stairways.

2. The path of claim 1 in which the slide includes a connector joining the slide and a pathway, the connector allowing rotational movement of the pathway with respect to an axis of the slide, such that the pathway, when disposed in front of the access opening is extensible over the stair or stairway barrier from and to the lower and upper levels.

3. The path of claim 1 in which at least one pathway includes a curb upwardly extending adjacent a side edge thereof.

4. The pathway of claim 1 in which the pathways are fixedly connected to each other a separation distance to correspond in location to the separated wheels of a wheelchair.

5. The path of claim 1 in which the slide is secured to an anchor located at at least one location selected from the group of: a wall adjacent the access opening, a level of a stair leading to the access opening, the upper level, the lower level, a stair tread, a stair riser, a front edge of a stair tread and a front edge of a stair riser.

6. The path of claim 1 including a means for positionally locating the lower end edge of a pathway at a predetermined location on the lower level when the pathway is extended to traverse the stair or stairway.

7. The path of claim 1 including a slide that laterally extends from within the access opening to one side of the access opening.

8. The path of claim 1 including a slide that laterally extends from within the access opening to each side of the access opening.

9. The path of claim 1 including a slide that is rotatable about an axis determined by a pivot point located adjacent a side of the access opening.

10. The path of claim 1 in which at least one pathway is fixed in position with respect to the slide.

11. The path of claim 1 in which the slide is essentially horizontally disposed.

12. The path of claim 1 in which the slide is initially disposed in an essentially vertical orientation with respect to the stair or stairway and is horizontally disposable to permit the pathways to traverse the stair or stairs.

13. A wheelchair access path system at an access opening having a stair or stairway leading from and to an upper level and a lower level, the system including at least a pair of longitudinally extending pathways sufficient in width to receive the wheels of the wheelchair and sufficient in length to traverse a stair or stairway leading from and to the upper level and a lower level at the access opening, a bi-directional rotator affixed adjacent the side of the access opening, one end of the pathways being secured to the rotator, and a section of the pathway a distance from the end secured to the rotator being securable at the opening by a receiver mounted adjacent the access opening.

* * * * *